US007319447B2

(12) United States Patent
Hsueh

(10) Patent No.: US 7,319,447 B2
(45) Date of Patent: Jan. 15, 2008

(54) PIXEL DRIVING CIRCUIT AND METHOD FOR USE IN ACTIVE MATRIX ELECTRON LUMINESCENT DISPLAY

(75) Inventor: Wei-Chieh Hsueh, Tainan (TW)

(73) Assignee: TPO Displays Corp., Chu-Nan (TW)

( * ) Notice: Subject to any disclaimer, the term of this patent is extended or adjusted under 35 U.S.C. 154(b) by 704 days.

(21) Appl. No.: 10/776,356

(22) Filed: Feb. 11, 2004

(65) Prior Publication Data

US 2004/0251839 A1 Dec. 16, 2004

(30) Foreign Application Priority Data

Feb. 11, 2003 (TW) ..... 92102771 A

(51) Int. Cl.
*G09G 3/32* (2006.01)

(52) U.S. Cl. ..... 345/82; 345/83; 345/84; 345/204

(58) Field of Classification Search ..... 345/82, 345/83, 84, 204
See application file for complete search history.

(56) References Cited

U.S. PATENT DOCUMENTS 6,693,388 B2 2/2004 Oomura
6,734,836 B2 5/2004 Nishitoba
6,774,877 B2 8/2004 Nishitoba et al.
6,859,193 B1 * 2/2005 Yumoto ..... 345/82
2003/0227262 A1 12/2003 Kwon
2004/0095299 A1 5/2004 Matsumoto

FOREIGN PATENT DOCUMENTS

| | | |
|---|---|---|
| JP | 2003-43995 | 2/2003 |
| JP | 2003-66905 | 3/2003 |
| JP | 2003-140613 | 5/2003 |
| WO | WO-99/65012 | 12/1999 |

* cited by examiner

*Primary Examiner*—Richard Hjerpe
*Assistant Examiner*—Leonid Shapiro

(57) ABSTRACT

A pixel driving circuit for use in an active matrix electron luminescent display includes a transistor, a capacitor and an organic light-emitting diode. The capacitor has a first and a second ends coupled to the gate electrode of the transistor and a ground voltage, respectively. The organic light-emitting diode has a P and an N electrode coupled to the source electrode of the transistor and the ground voltage, respectively. The capacitor is charged by a driving current received from a data line to generate a specified voltage to bias the transistor and the organic light-emitting diode in the memorizing state, and the transistor and the organic light-emitting diode are further biased with the specified voltage in the emission state.

14 Claims, 8 Drawing Sheets

PIXEL DRIVING CIRCUIT AND METHOD FOR USE IN ACTIVE MATRIX ELECTRON LUMINESCENT DISPLAY

FIELD OF THE INVENTION

The present invention relates to a pixel driving circuit, and more particularly to a pixel driving circuit for use in an active matrix electron luminescent display. The present invention also relates to a pixel driving method.

BACKGROUND OF THE INVENTION

With increasing development of digital technology, panel displays become essential components of many electrical appliances such as notebooks, mobile phones, information appliances (IA) and personal digital assistants (PDAs). Since the typical liquid crystal display (LCD) needs backlight and is complicated to be fabricated, alternative displays are further developed. Recently, a display by means of organic light-emitting diodes (OLEDs) has been developed due to its self-light-emitting and easily manufactured features. In addition, the OLED display has advantages of wider viewing angle, low cost, reduced thickness and flexible operational temperature. The OLEDs can be used in pixel units of an active matrix electron luminescent display to emit light, and the OLED display is expected to substitute for the LCD in the near future. The OLED pixels are generally driven in either a voltage-driving manner, as shown in FIG. 1, or a current-driving manner, as shown in FIG. 2, which will be described hereinafter.

Please refer to FIG. 1, in which a conventional pixel driving circuit of an OLED display is shown. Each of the pixel units comprises an organic light-emitting diode OLED, two transistors M1~M2 and a capacitor Cs. The gate electrode of the transistor M1 is coupled to a gate line 10, and the other two electrodes of the transistor M1 are coupled to a data line 20 and the gate electrode of the transistor M2, respectively. The source and drain electrodes of the transistor M2 are coupled to a source voltage Vdd and the P electrode of the organic light-emitting diode OLED. The N electrode of the organic light-emitting diode OLED is coupled to a ground voltage GND. The capacitor Cs is coupled between the source electrode and gate electrode of the transistor M2.

During operation of the gate line 10, the transistor M1 is switched on. Meanwhile, via the data line 20, a driving voltage is inputted and stored in the capacitor Cs. The driving voltage can also bias the transistor M2 to result in a constant current Id passing through the organic light-emitting diode OLED. The organic light-emitting diode OLED emits light accordingly.

For a purpose of forming the active matrix and its peripheral circuit on the same substrate, a so-called low-temperature polysilicon thin film transistor (LTPS-TFT) technology was developed with improved electrical properties of TFTs and other benefits. However, since the threshold voltage and mobility of such LTPS-TFT vary with manufacturing processes to a certain extent, some problems may occur. For example, under a constant voltage applied to the capacitor Cs, the resulting intensity of current passing through the organic light-emitting diode OLED may be different for the LTPS-TFT manufactured by different processes. The light intensity emitted by the OLED cannot be well expected.

FIG. 2 illustrates another conventional driving circuit for driving an OLED pixel. Each of the pixel units comprises an organic light-emitting diode OLED, four transistors M1~M4 and a capacitor Cs. The gate electrode of the transistor M1 is coupled to a first scan line 30, and the other two electrodes of the transistor M1 are coupled to a data line 50 and the drain electrode of the transistor M3, respectively. The gate electrode of the transistor M2 is coupled to the first scan line 30, and the other two electrodes of the transistor M2 are coupled to the data line 50 and the gate electrode of the transistor M3, respectively. The source and drain electrodes of the transistor M3 are coupled to a source voltage Vdd and the drain electrode of the transistor M4, respectively. The gate and drain electrodes of the transistor M4 are coupled to a second scan line 40 and the P electrode of the organic light-emitting diode OLED, respectively. The N electrode of the organic light-emitting diode OLED is coupled to a ground voltage GND. The capacitor Cs is coupled between the source electrode and gate electrode of the transistor M3.

The circuit of FIG. 2 can be operated in either a memorizing or an emission state, which are controlled by the first scan line 30 and the second scan line 40, respectively. The first scan line 30 and the second scan line 40 use the same clock signal. When the clock signal is at a high level, the first scan line 30 operates and thus the transistors M1 and M2 are switched on. Whereas, when the clock signal is at a low level, the second scan line 40 operates and thus the transistor M4 is switched on.

When the circuit is operated in the memorizing state, the first scan line 30 works to switch on the transistors M1 and M2, but the second scan line 40 suspends operation such that the transistor M4 is switched off. At this time, a current from the voltage source Vdd will charge the capacitor Cs to generate voltage. The voltage applied to the capacitor Cs can bias the transistor M3 to result in a driving current Id1 passing through the transistors M3 and M1 to the data line 50. Meanwhile, no driving current passes through the transistor M4.

When the circuit is operated in the emission state, the first scan line 30 suspends operation such that the transistors M1 and M2 are closed, but the second scan line 40 works to switch on the transistor M4. Therefore, the driving current Id1 is zero. At this time, the voltage applied to the capacitor Cs will bias the transistor M3 to result in a driving current Id2 passing through the organic light-emitting diode OLED. The organic light-emitting diode OLED emits light accordingly.

The deviations of threshold voltage and mobility, which are caused in the driving circuit of FIG. 1, can be compensated by using the driving circuit of FIG. 2. However, since the equivalent impedance at the drain electrode of the transistor M3, i.e. the node a, in the memorizing state and in the emission state are different, the driving currents Id1 and Id2 are different even when an identical biased voltage is applied. As can be seen in FIG. 3, when the transistor M3 is biased by various biased voltages VCs1~VCs10, different quantities of driving currents Id1 and Id2 are observed in the memorizing and the emission states, respectively.

SUMMARY OF THE INVENTION

It is an object of the present invention to provide a pixel driving circuit and method for use in an active matrix electron luminescent display in a current-driven mode, in which the current passing through the organic light-emitting diode is substantially identical in the memorizing and the emission states.

In accordance with a first aspect of the present invention, there is provided a pixel driving circuit for use in an active matrix electron luminescent display. The pixel driving circuit is switched between a memorizing state and an emission state according to operations of a first and a second scan lines. The pixel driving circuit comprises a transistor, a capacitor and an organic light-emitting diode. The capacitor has a first and a second ends coupled to the gate electrode of the transistor and a ground voltage, respectively. The organic light-emitting diode has a P and an N electrode coupled to the source electrode of the transistor and the ground voltage, respectively. The capacitor is charged by a driving current received from a data line to generate a specified voltage to bias the transistor and the organic light-emitting diode in the memorizing state, and the transistor and the organic light-emitting diode are further biased with the specified voltage in the emission state.

In an embodiment, the pixel driving circuit further comprises a memorizing state circuit coupled to the first scan line, the data line, the gate electrode of the transistor and the drain electrode of the transistor, and permitting the driving current from the data line to be transmitted therevia to charge the capacitor and pass through the transistor and the organic light-emitting diode in the memorizing state.

In an embodiment, the pixel driving circuit further comprises an emission state circuit coupled to a voltage source, the drain electrode of the transistor and the second scan line, and generating a current in response to the specified voltage to pass through the transistor and the organic light-emitting diode in the emission state.

In an embodiment, the pixel driving circuit further comprises a first switch unit and a second switch unit. The first switch unit has a first and a second ends coupled to the data line and the drain electrode of the transistor, respectively, and a first control end coupled to the first scan line. The second switch unit has a third and a fourth ends coupled to the drain electrode and the gate electrode of the transistor, respectively, and a second control end coupled to the first scan line. In another embodiment, the pixel driving circuit further comprises a third switch unit having a fifth and a sixth ends coupled to a voltage source and the drain electrode of the transistor, respectively, and a third control end coupled to the second scan line.

In an embodiment, the pixel driving circuit further comprises a first switch unit and a second switch unit. The first switch unit has a first and a second ends coupled to the data line and the drain electrode of the transistor, respectively, and a first control end coupled to the first scan line. The second switch unit has a third and a fourth ends coupled to the data line and the gate electrode of the transistor, respectively, and a second control end coupled to the first scan line. In another embodiment, the pixel driving circuit further comprises a third switch unit having a fifth and a sixth ends coupled to a voltage source and the drain electrode of the transistor, respectively, and a third control end coupled to the second scan line.

In an embodiment, the pixel driving circuit is switched between the memorizing state and the emission state in response to a clock signal for controlling the operations of the first and the second scan lines.

In accordance with a second aspect of the present invention, there is provided a pixel driving circuit for use in an active matrix electron luminescent display. The pixel driving circuit is switched between a memorizing state and an emission state according to operations of a first and a second scan lines. The pixel driving circuit comprises a transistor, a capacitor and an organic light-emitting diode. The capacitor has a first and a second ends coupled to the gate electrode of the transistor and a voltage source, respectively. The organic light-emitting diode has a P and an N electrode coupled to the voltage source and the source electrode of the transistor, respectively. The capacitor is charged by a driving current transmitted from the voltage source to generate a specified voltage to bias the transistor and the organic light-emitting diode in the memorizing state, and the transistor and the organic light-emitting diode are further biased with the specified voltage in the emission state.

In accordance with a third aspect of the present invention, there is provided a method for driving a pixel unit of an active matrix electron luminescent display, which comprises a capacitor, a transistor and an organic light-emitting diode. Firstly, a current path is provided for a driving current to charge the capacitor to a specified voltage when the first scan line is operating. Then, a biasing current is generated in response to the specified voltage to pass through the organic light-emitting diode when the second line is operating. Specifically, the specific voltage biases the gate electrode of the transistor and the organic light-emitting diode serially coupled to each other.

In an embodiment, the current path permits the driving current to be transmitted between a data line and the capacitor so to charge the capacitor to a specified voltage.

In an embodiment, the P electrode of the organic light-emitting diode is coupled to the source electrode of the transistor, the capacitor has a first and a second end coupled to the gate electrode of the transistor and the N electrode of the organic light-emitting diode, and each of the driving current and the biasing current passes through the source and the drain electrode of the transistor.

In an embodiment, the N electrode of the organic light-emitting diode is coupled to the drain electrode of the transistor, the capacitor has a first and a second end coupled to the gate electrode of the transistor and the P electrode of the organic light-emitting diode, and each of the driving current and the biasing current passes through the source and the drain electrode of the transistor.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
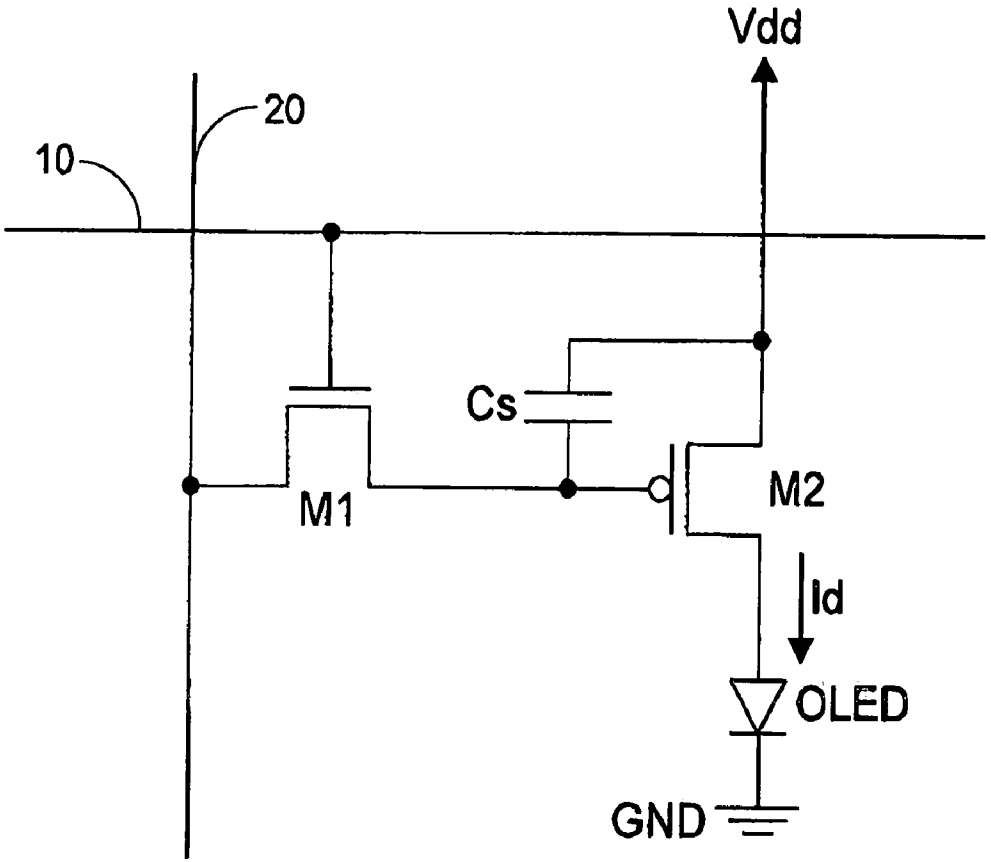
Fig. 1 PRIOR ART
FIG. 1 is a schematic circuit diagram illustrating a conventional pixel driving circuit of an OLED display.
Figure 2:
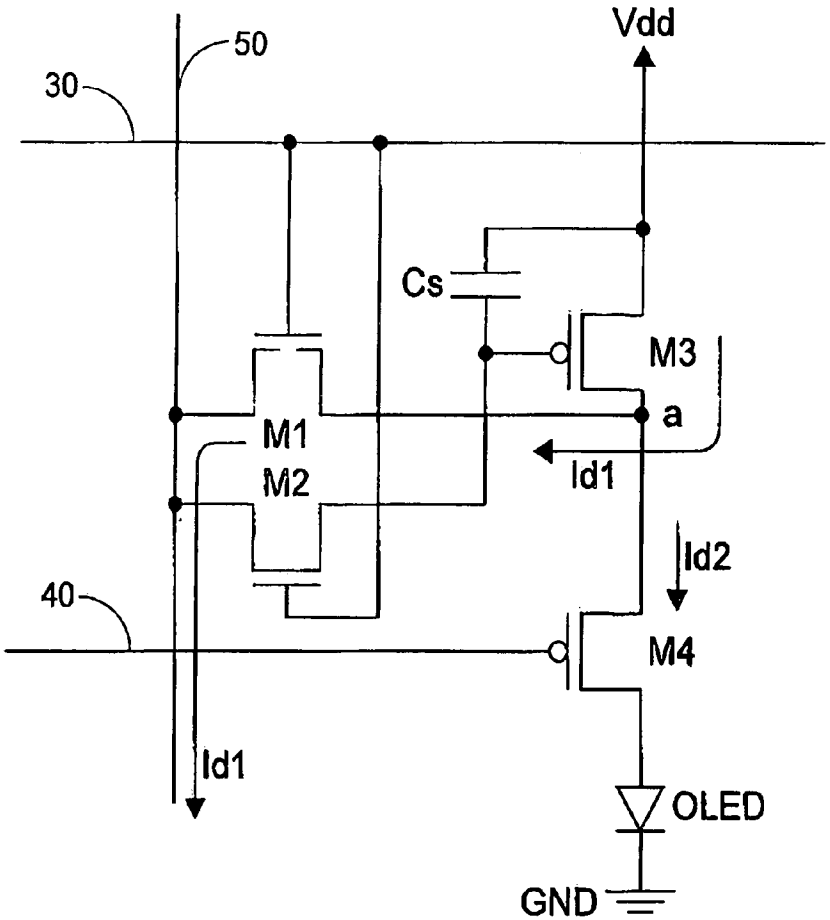
Fig.2 PRIOR ART
FIG. 2 is a schematic circuit diagram illustrating another conventional pixel driving circuit of an OLED display.
Figure 3:
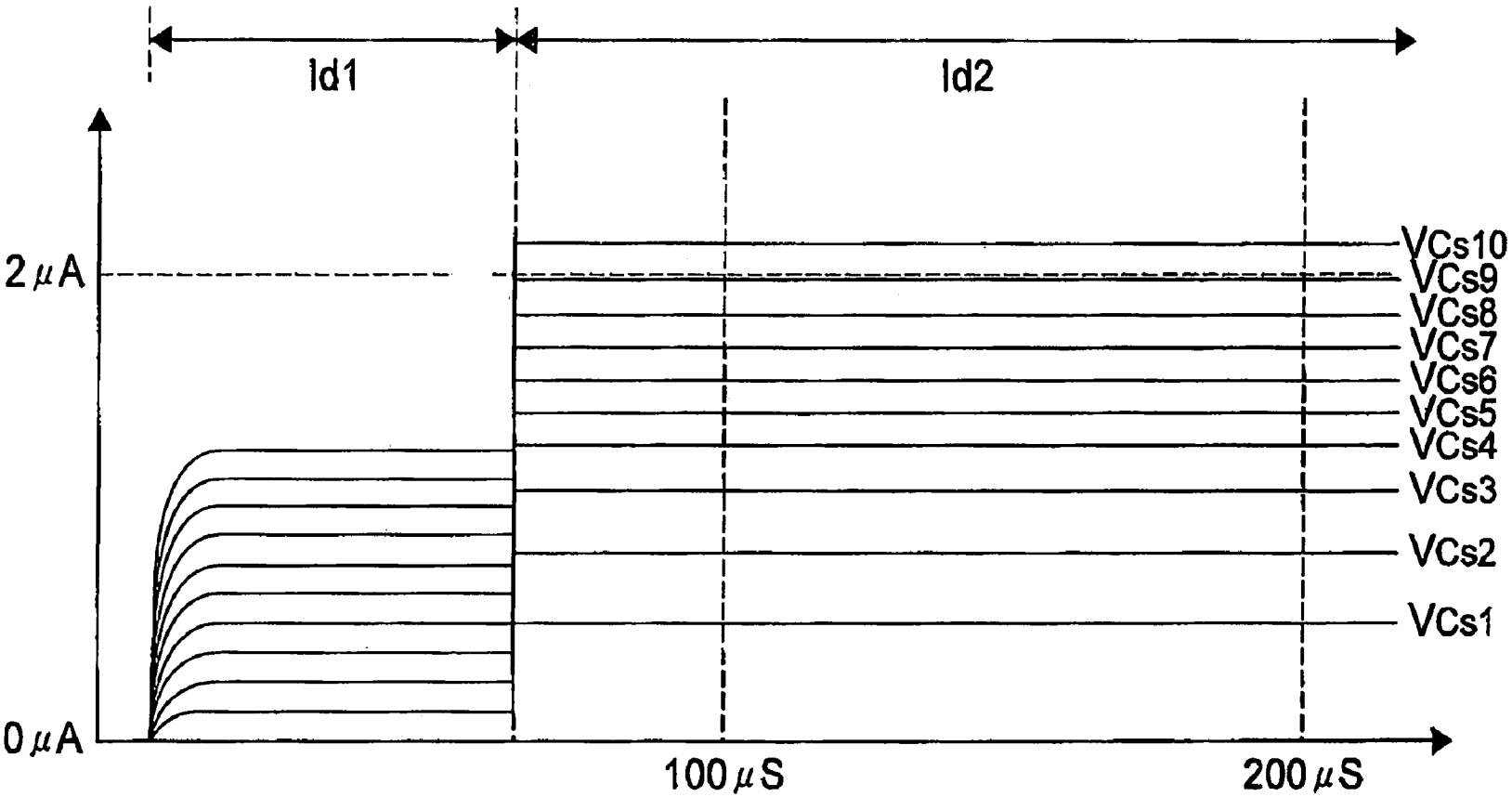
Fig.3 PRIOR ART
FIG. 3 is a current variation diagram of the pixel driving circuit for driving the OLED of FIG. 2 from a memorizing state to an emission state.
Figure 4:
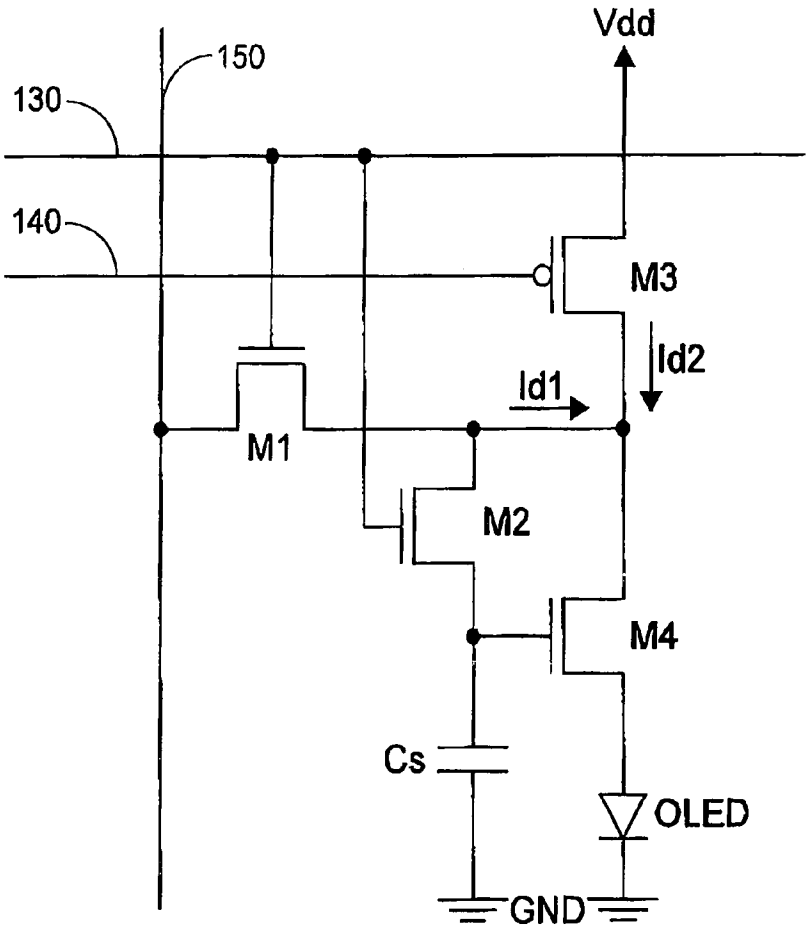
FIG. 4 is a schematic circuit diagram illustrating a pixel driving circuit of an OLED display according to a first embodiment of the present invention.

FIG. 4 illustrates a pixel driving circuit for driving an OLED pixel according to a preferred embodiment of the present invention. Each of the pixel units comprises an organic light-emitting diode OLED, transistors M1~M4 and a capacitor Cs. The gate electrode of the transistor M1 is coupled to a first scan line 130, and the other two electrodes of the transistor M1 are coupled to a data line 150 and the drain electrode of the transistor M3, respectively. The gate electrode of the transistor M2 is coupled to the first scan line 130, and the other two electrodes of the transistor M2 are coupled to the drain electrode of the transistor M3 and the gate electrode of the transistor M4, respectively. The source and gate electrodes of the transistor M3 are coupled to a voltage source Vdd and a second scan line 140. The other two electrodes of the transistor M4 are coupled to the drain electrode of the transistor M3 and the P electrode of the organic light-emitting diode OLED. The N electrode of the organic light-emitting diode OLED is coupled to a ground voltage GND. The capacitor Cs is coupled between the gate electrode of the transistor M4 and the ground voltage GND.

The circuit of FIG. 4 is operated in alternate memorizing and emission states, which are controlled by the first scan line 130 and the second scan line 140, respectively. The first scan line 130 and the second scan line 140 are alternately enabled in response to the same clock signal. When the clock signal is at a high level, the first scan line 130 operates and thus the transistors M1 and M2 are switched on. Whereas, when the clock signal is at a low level, the second scan line 140 operates and thus the transistor M3 is switched on.

In the memorizing state, the first scan line 130 is enabled to switch on the transistors M1 and M2, and the second scan line 140 is disabled such that the transistor M3 is switched off. At this time, a driving current transmitted from the data line 150 will charge the capacitor Cs to a specified voltage. The specified voltage applied to the capacitor Cs biases the transistor M4 and the organic light-emitting diode OLED such that the driving current Id1 transmitted from the data line 150 flows through the transistor M4 and the organic light-emitting diode OLED to have the OLED emit light. Meanwhile, no driving current passes through the transistor M3, i.e. Id2=0.

In the emission state, the first scan line 130 suspends operation such that the transistors M1 and M2 are closed, i.e. Id1=0. In stead, the second scan line 140 is enabled to switch on the transistor M3. The voltage applied to the capacitor Cs biases the transistor M4 and the organic light-emitting diode OLED so as to result in a driving current Id2 passing through the organic light-emitting diode OLED. The organic light-emitting diode OLED emits light accordingly.

Figure 5:
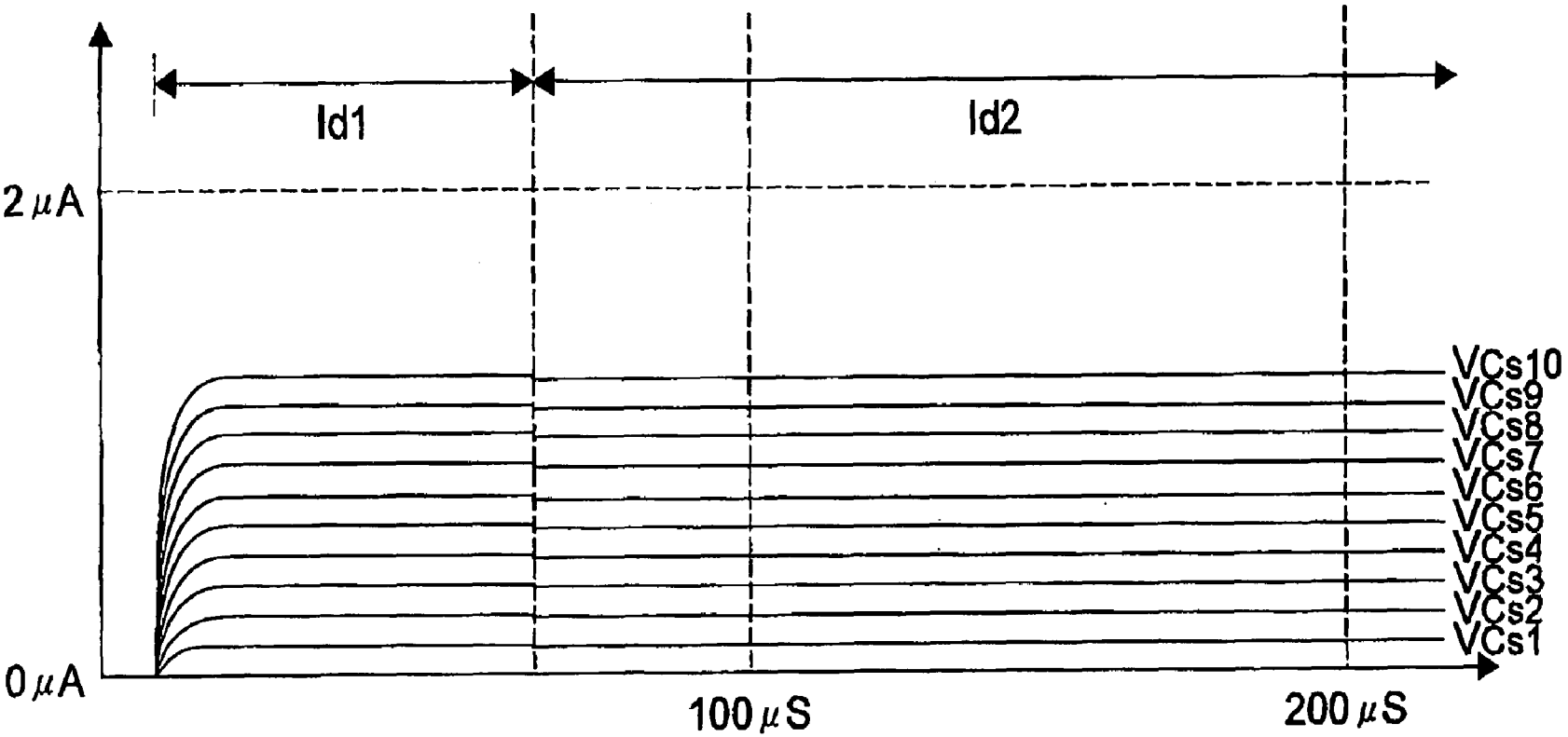
FIG. 5 is a current variation diagram of the pixel driving circuit for driving the OLED of FIG. 4 from a memorizing state to an emission state.

Since the specified voltage applied to the capacitor Cs is used to bias the transistor M4 and the organic light-emitting diode OLED in both the memorizing and the emission states, the driving currents Id1 and Id2 are substantially identical. As can be seen in FIG. 5, when the transistor M4 and the organic light-emitting diode OLED are biased by various biased voltages VCs1~VCs10, the quantities of driving currents Id1 and Id2 flowing through the transistor M4 and the organic light-emitting diode OLED in the memorizing and the emission states, respectively, are very close to each other.

Figure 6:
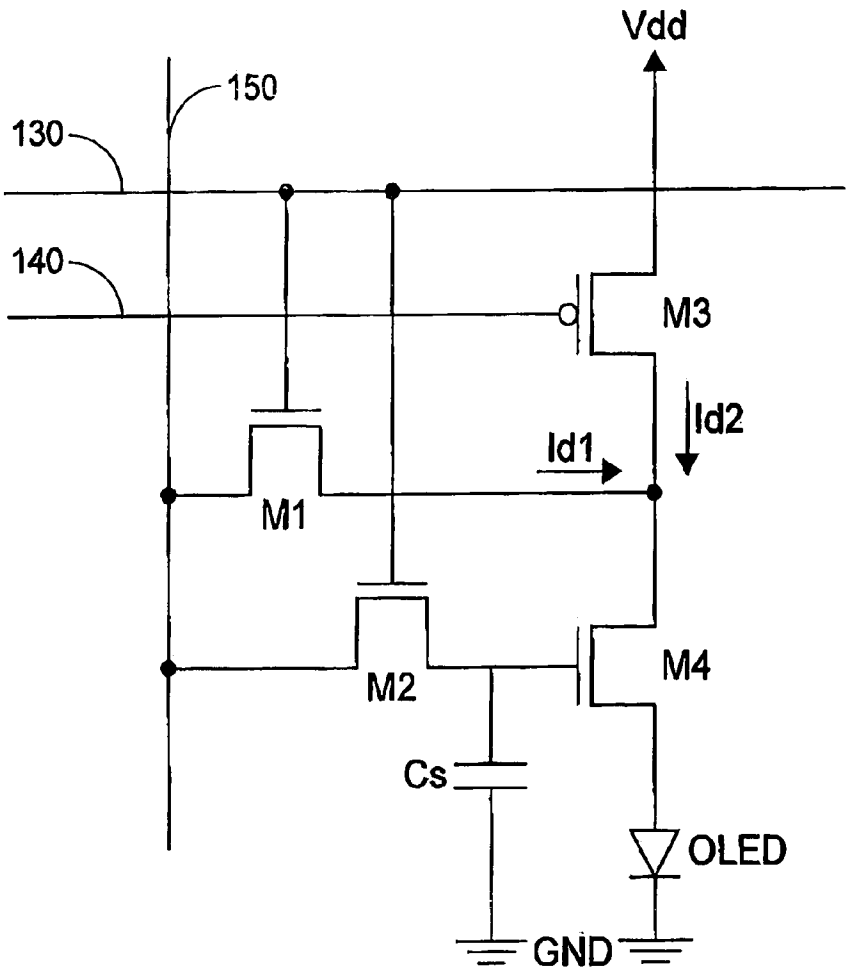
FIG. 6 is a schematic circuit diagram illustrating a pixel driving circuit of an OLED display according to a second embodiment of the present invention.

The driving circuit shown in FIG. 6 is similar to that of FIG. 4 except that the gate electrode of the transistor M2 is coupled to the first scan line 130, and the other two electrodes of the transistor M2 are coupled to the data line 150 and the gate electrode of the transistor M4, respectively. Likewise, since the specified voltage applied to the capacitor Cs biases the transistor M4 and the organic light-emitting diode OLED in both the memorizing and the emission states, the driving currents Id1 and Id2 are substantially identical.

Figure 7:
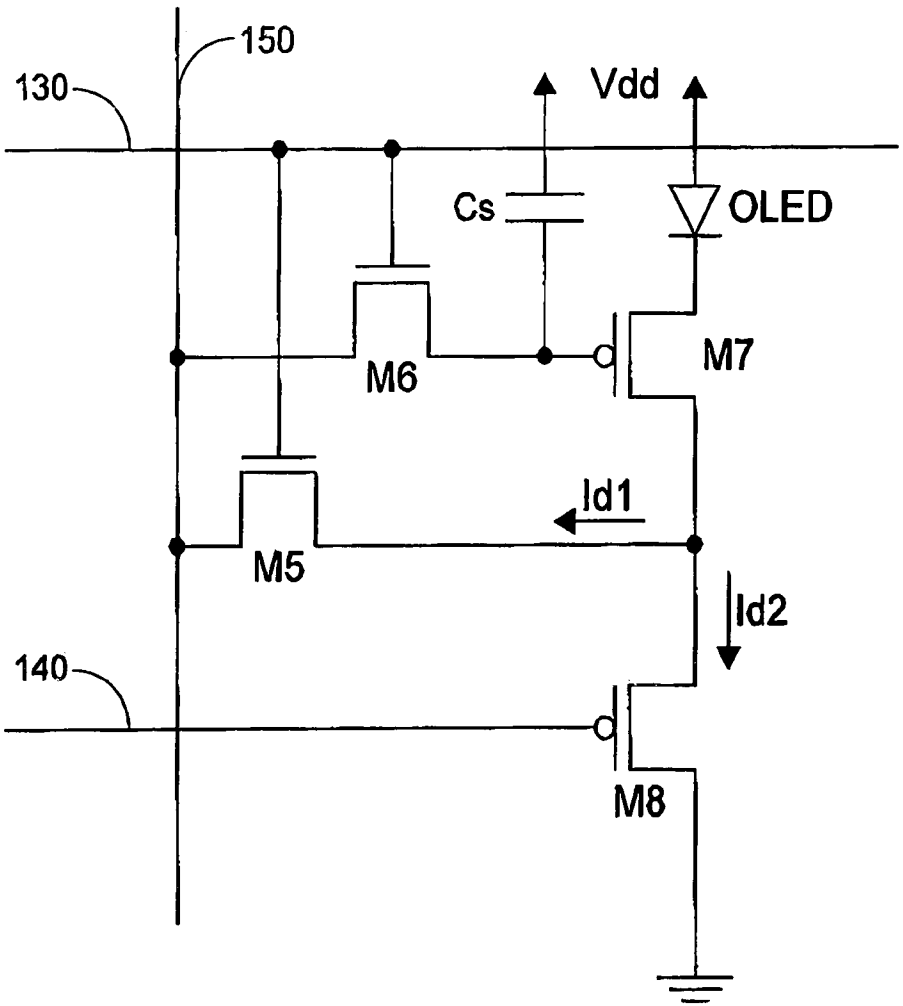
FIG. 7 is a schematic circuit diagram illustrating a pixel driving circuit of an OLED display according to a third embodiment of the present invention.

FIG. 7 illustrates a pixel driving circuit for driving an OLED display pixel according to a further preferred embodiment of the present invention. Each of the pixel units comprises an organic light-emitting diode OLED, transistors M5~M8 and a capacitor Cs. The gate electrode of the transistor M5 is coupled to a first scan line 130, and the other two electrodes of the transistor M1 are coupled to a data line 150 and the drain electrode of the transistor M7, respectively. The gate electrode of the transistor M6 is coupled to the first scan line 130, and the other two electrodes of the transistor M6 are coupled to the data line 150 and the gate electrode of the transistor M7, respectively. The P electrode of the organic light-emitting diode OLED is coupled to a voltage source Vdd. The capacitor Cs is coupled between the gate electrode of the transistor M7 and the voltage source Vdd. The source electrode of the transistor M7 is coupled to the N electrode of the organic light-emitting diode OLED. The gate electrode of the transistor M8 is coupled to the second scan line 140, and the other two electrodes of the transistor M8 are coupled to the drain electrode of the transistor M7 and a ground voltage GND.

The circuit of FIG. 7 is operated in alternate memorizing and emission states, which are controlled by the first scan line 130 and the second scan line 140, respectively. The first scan line 130 and the second scan line 140 are alternately enabled in response to the same clock signal. When the clock signal is at a high level, the first scan line 130 operates and thus the transistors M5 and M6 are switched on. Whereas, when the clock signal is at a low level, the second scan line 140 operates and thus the transistor M8 is switched on.

In the memorizing state, the first scan line 130 is enabled to switch on the transistors M5 and M6, and the second scan line 140 is disabled such that the transistor M8 is switched off. At this time, a driving current transmitted from the data line 150 will charge the capacitor Cs to a specified voltage. The specified voltage applied to the capacitor Cs biases the transistor M7 and the organic light-emitting diode OLED such that the driving current Id1 transmitted from the data line 150 flows through the transistor M7 and the organic light-emitting diode OLED to have the OLED emit light. Meanwhile, no driving current passes through the transistor M7, i.e. Id2=0.

In the emission state, the first scan line 130 suspends operation such that the transistors M5 and M6 are closed, i.e. Id1=0. In stead, the second scan line 140 is enabled to switch on the transistor M8. The voltage applied to the capacitor Cs biases the transistor M8 and the organic light-emitting diode OLED so as to result in a driving current Id2 passing through the organic light-emitting diode OLED. The organic light-emitting diode OLED emits light accordingly. Since the specified voltage applied to the capacitor Cs is used to bias the transistor M8 and the organic light-emitting diode OLED in both the memorizing and the emission states, the driving currents Id1 and Id2 are substantially identical.

Figure 8:
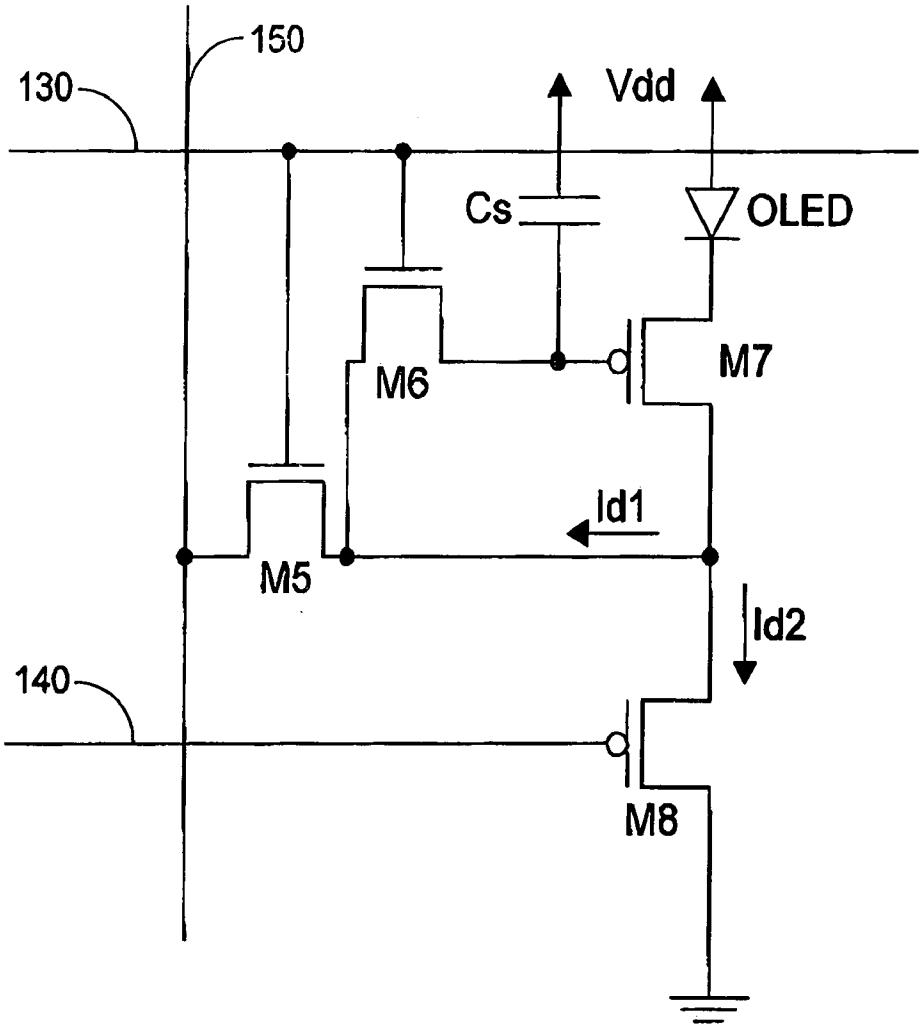
FIG. 8 illustrates a pixel driving circuit of an OLED display according to a fourth embodiment of the present invention.

The driving circuit shown in FIG. 8 is similar to that of FIG. 7 except that the gate electrode of the transistor M6 is coupled to the first scan line 130, and the other two electrodes of the transistor M6 are coupled to the drain electrode and the gate electrode of the transistor M7, respectively. Likewise, since the specified voltage applied to the capacitor Cs biases the transistor M7 and the organic light-emitting diode OLED in both the memorizing and the emission states, the driving currents Id1 and Id2 are substantially identical.

From the above description, it is understood that the current passing through the organic light-emitting diode can be substantially identical in the memorizing and the emission states by using the pixel driving circuit of the present invention.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A pixel driving circuit for use in an active matrix electron luminescent display, switched between a memorizing state and an emission state according to operations of a first and a second scan lines, comprising:

a transistor;

a capacitor having a first and a second ends coupled to the gate electrode of said transistor and a ground voltage, respectively;

an organic light-emitting diode having a P and an N electrodes coupled to the source electrode of said transistor and said ground voltage, respectively;

a first switch unit having a first and a second ends coupled to a data line and the drain electrode of said transistor, respectively, and a first control end coupled to said first scan line; and a second switch unit having a third and a fourth ends coupled to the drain electrode and the gate electrode of said transistor, respectively, and a second control end coupled to said first scan line, wherein said capacitor is charged by a driving current received from said data line to generate a specified voltage to bias said transistor and said organic light-emitting diode in said memorizing state, and said transistor and said organic light-emitting diode are further biased with said specified voltage in said emission state.

2. The pixel driving circuit according to claim 1 wherein said first switch unit and said second switch unit form a memorizing state circuit coupled to said first scan line, said data line, the gate electrode of said transistor and the drain electrode of said transistor, and permitting said driving current from said data line to be transmitted therevia to charge said capacitor and pass through said transistor and said organic light-emitting diode in said memorizing state.

3. The pixel driving circuit according to claim 1 further comprising an emission state circuit coupled to a voltage source, the drain electrode of said transistor and said second scan line, and generating a current in response to said specified voltage to pass through said transistor and said organic light-emitting diode in said emission state.

4. The pixel driving circuit according to claim 1 further comprising a third switch unit having a fifth and a sixth ends coupled to a voltage source and the drain electrode of said transistor, respectively, and a third control end coupled to said second scan line.

5. The pixel driving circuit according to claim 1 wherein said pixel driving circuit is switched between said memorizing state and said emission state in response to a clock signal for controlling said operations of said first and said second scan lines.

6. A pixel driving circuit for use in an active matrix electron luminescent display, switched between a memorizing state and an emission state according to operations of a first and a second scan lines, comprising:

a transistor;

a capacitor having a first and a second ends coupled to the gate electrode of said transistor and a voltage source, respectively; and an organic light-emitting diode having a P and an N electrodes coupled to said voltage source and the source electrode of said transistor, respectively;

a first switch unit having a first and a second ends coupled to a data line and the drain electrode of said transistor, respectively, and a first control end coupled to said first scan line; and a second switch unit having a third and a fourth ends coupled to the drain electrode and the gate electrode of said transistor, respectively, and a second control end coupled to said first scan line, wherein said capacitor is charged by a driving current transmitted from said voltage source to generate a specified voltage to bias said transistor and said organic light-emitting diode in said memorizing state, and said transistor and said organic light-emitting diode are further biased with said specified voltage in said emission state.

7. The pixel driving circuit according to claim 6 wherein said first switch unit and said second switch unit form a memorizing state circuit coupled to said first scan line, said data line, the gate electrode of said transistor and the drain electrode of said transistor, and permitting said driving current from said voltage source to be transmitted therevia to charge said capacitor and pass through said transistor, said data line and said organic light-emitting diode in said memorizing state.

8. The pixel driving circuit according to claim 6 further comprising an emission state circuit coupled to a ground voltage, the drain electrode of said transistor and said second scan line, and generating a current in response to said specified voltage to pass through said transistor and said organic light-emitting diode in said emission state.

9. The pixel driving circuit according to claim 6 further comprising a third switch unit having a fifth and a sixth ends coupled to a ground voltage and the drain electrode of said transistor, respectively, and a third control end coupled to said second scan line.

10. The pixel driving circuit according to claim 6 wherein said pixel driving circuit is switched between said memorizing state and said emission state in response to a clock signal for controlling said operations of said first and said second scan lines.

11. A pixel driving circuit for use in an active matrix electron luminescent display, switched between a memorizing state and an emission state according to operations of a first and a second scan lines, comprising:

a transistor;

a capacitor having a first and a second ends coupled to the gate electrode of said transistor and a ground voltage, respectively;

an organic light-emitting diode having a P and an N electrodes coupled to the source electrode of said transistor and said ground voltage, respectively;

a first switch unit having a first and a second ends coupled to a data line and the drain electrode of said transistor, respectively, and a first control end coupled to said first scan line; and a second switch unit having a third and a fourth ends coupled to said data line and the gate electrode of said transistor, respectively, and a second control end coupled to said first scan line, wherein said capacitor is charged by a driving current received from said data line to generate a specified voltage to bias said transistor and said organic light-emitting diode in said memorizing state, and said transistor and said organic light-emitting diode are further biased with said specified voltage in said emission state.

12. The pixel driving circuit according to claim 11 further comprising a third switch unit having a fifth and a sixth ends coupled to a voltage source and the drain electrode of said transistor, respectively, and a third control end coupled to said second scan line.

13. A pixel driving circuit for use in an active matrix electron luminescent display, switched between a memorizing state and an emission state according to operations of a first and a second scan lines, comprising:

a transistor;

a capacitor having a first and a second ends coupled to the gate electrode of said transistor and a voltage source, respectively; and an organic light-emitting diode having a P and an N electrodes coupled to said voltage source and the source electrode of said transistor, respectively;

a first switch unit having a first and a second ends coupled to a data line and the drain electrode of said transistor, respectively, and a first control end coupled to said first scan line; and a second switch unit having a third and a fourth ends coupled to said data line and the gate electrode of said transistor, respectively, and a second control end coupled to said first scan line, wherein said capacitor is charged by a driving cunent transmitted from said voltage source to generate a specified voltage to bias said transistor and said organic light-emitting diode in said memorizing state, and said transistor and said organic light-emitting diode are further biased with said specified voltage in said emission state.

14. The pixel driving circuit according to claim 13 further comprising a third switch unit having a fifth and a sixth ends coupled to a ground voltage and the drain electrode of said transistor, respectively, and a third control end coupled to said second scan line.

* * * * *